US005819605A

United States Patent [19]

Buck et al.

[11] Patent Number: 5,819,605

[45] Date of Patent: Oct. 13, 1998

[54] LOW FRICTION POWER TONG JAW ASSEMBLY

[76] Inventors: David A. Buck, 1348 Sawmill Hwy., Breaux Bridge, La. 70517; Daniel S. Bangert, 156 Beau Coteau Pkwy., Broussard, La. 70518

[21] Appl. No.: 862,555

[22] Filed: May 23, 1997

[51] Int. Cl.[6] ..... B25B 13/50

[52] U.S. Cl. ..... 81/57.33; 81/57.18

[58] Field of Search ..... 81/57.18, 57.2, 81/57.33

[56] References Cited

U.S. PATENT DOCUMENTS 4,649,777 3/1987 Buck .

4,709,599 12/1987 Buck .

5,435,213 7/1995 Buck .

*Primary Examiner*—James G. Smith

*Attorney, Agent, or Firm*—Roy, Kiesel & Tucker

[57] ABSTRACT

The present invention provides an improved power tong jaw having a jaw body with a roller aperture formed therein. A jaw roller is positioned in said roller aperture by some type of retaining surface, such as a roller pin. Additionally, a friction reducing surface is formed between the jaw roller and the jaw pin. In one embodiment, this friction reducing surface comprises a plurality of needle bearings. In alternate embodiments, the friction reducing surface comprises ball bearings, journal bearings, or recirculating ball bearings.

13 Claims, 9 Drawing Sheets

LOW FRICTION POWER TONG JAW ASSEMBLY

FIELD OF INVENTION

The present invention relates to tools used in the oil and gas drilling industry, such as power tongs, to grip and apply torque to drill pipe and other tubular members. More particularly, the present invention relates to the jaw members of the power tong and an improved structure for such jaw members.

BACKGROUND OF INVENTION

The use of power tongs to make up and break apart threaded connections on drill pipe and similar tubulars is well known in the oil and gas industry. Typically the power tong will have at least two jaw members which ride on cam surfaces in order to bring the jaws into and out of contact with the tubular. An example of this camming mechanism is shown in U.S. Pat. No. 5,435,213 to David A. Buck, which is incorporated by reference herein. The jaw members themselves have also been the subject of inventive effort as evidenced by U.S. Pat. Nos. 4,709,599, 4,649,777 and U.S. application Ser. No. 08/805,442, filed on Feb. 25, 1997, all to David A. Buck and all incorporated by reference herein. The jaw members typically will have roughened or knurled gripping surface which will allow the jaw members to superficially penetrate or "bite" into the outer surface of a tubular and thereby securely grip the tubular.

Generally, the jaw members are mounted between upper and lower cage plates which may rotate within the body of the power tongs. The jaw members mounting in the cage plates allows the jaw members may move radially toward and away from the tubular in order to selectively engage and disengage the tubular. As explained in more detail below, this radial movement is effected by rollers on the jaw members traveling along cam surfaces positioned on a ring gear. Applying torque to the ring gear will urge the rollers or cam followers of the jaw members up the cam surfaces so that the jaw members close on the tubular. The power tong is structured so that initial rotation of the ring gear causes the jaw members to exert radial force on the tubular, but the jaw members do not initially transfer torque to the tubular. However, continued rotation of the ring gear will begin to impart both an increasing radial force and torque to the tubular.

The purpose of the jaw members first applying radial force to the tubular is to insure that the jaw members have moved against the tubular with sufficient radial force so as to prevent the jaw members from slipping on the surface of the tubular when torque begins to be applied to the tubular. If the jaw members have not achieved a secure bite on the tubular as the torque load rises, slipping of the jaws will prevent the tubular joint from being properly made up or broken apart and will badly scar the outer surface of the tubular. This scarring is of particular concern when gripping tubulars manufacture from stainless steel or other costly corrosion resistant alloys. Therefore it is desirable for the jaw members to maximize the amount of radial force transferred to the tubular in order to securely grip the tubular before sufficient torque is supply to cause slipping.

Different factors effect the amount of radial force produced by a given increase in torque. One factor is the cam surface's angle of inclination. Lower cam angles transfer a greater radial load to the tubular as torque increases than do higher cam angles. Another factor effecting the radial load transferred to the tubular will be frictional forces resisting the increasing torque load. For example, frictional forces operating on the jaw member's roller will tend to inhibit radial forces by restricting the jaw members movement up the cam surface.

The problems of preventing slipping are also more pronounced when dealing with smaller tubulars, such as in the range of 1¼ inches to 5½ inches in outer diameter. Primarily because the smaller diameter tubulars have less surface area to grip, a large amount of radial force is needed to prevent slippage as torque is applied. This problem is compounded by frictional forces that retard the movement of the jaw member's roller along the cam surface. Torque must be applied to overcome these frictional forces, but the torque expended overcoming the frictional forces is not translated into radial force and therefore increases the likelihood of slippage. What is needed in the art to overcome this disadvantage is a jaw member that will reduce frictional forces related to the jaw member's roller.

OBJECTS AND SUMMARY OF INVENTION

It is an object of the present invention to provide an improved jaw member for a power tong tool.

It is another object of the present invention to provide a jaw member that travels upon a cam surface with considerably less friction than hereto known in the art.

It is also an object to provide a jaw member having a low friction surface positioned between the jaw roller and the device connecting the roller to the jaw member.

Therefore the present invention provides an improved power tong jaw having a jaw body with a roller aperture formed therein. A jaw roller is positioned in said roller aperture by some type of retaining surface, such as a roller pin. Additionally, a friction reducing surface is formed between the jaw roller and the jaw pin. In one embodiment, this friction reducing surface comprises a plurality of needle bearings.

DETAILED DESCRIPTION

Figure 1:
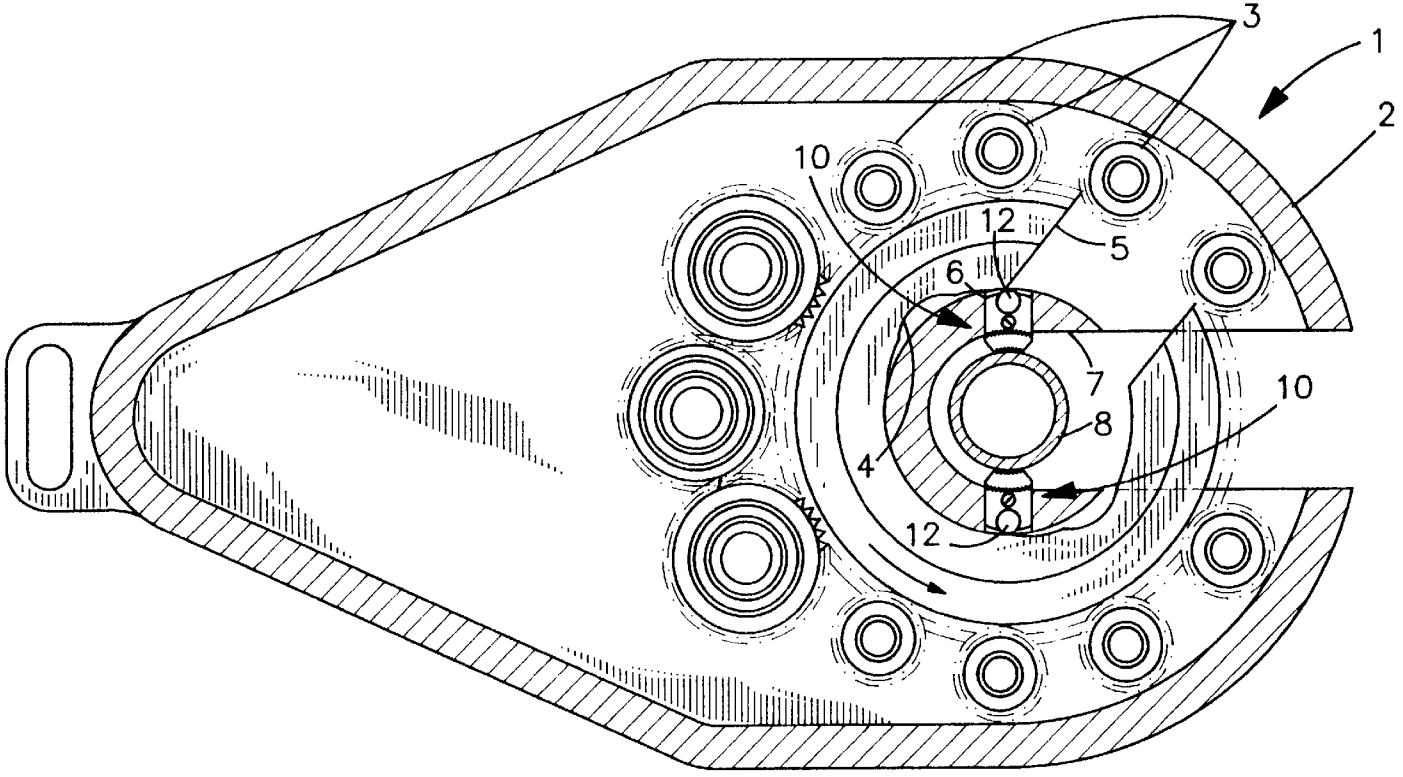
PRIOR ART FIGURE 1
FIG. 1 is a top view of a conventional power tong with the cover plate and upper cage plated removed in order to show the power tong's main internal components.
Figure 2:
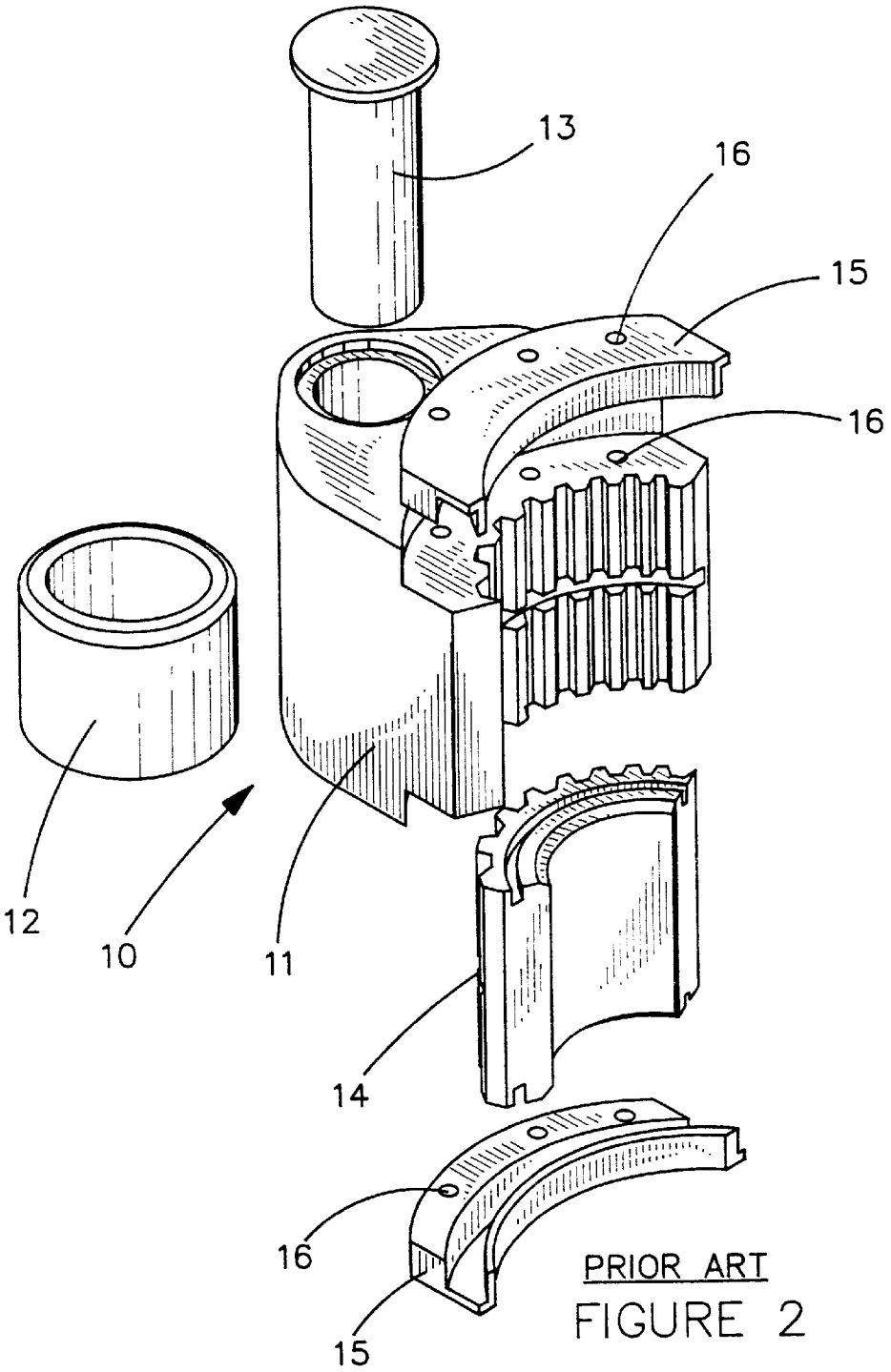
PRIOR ART FIGURE 2
FIG. 2 is a perspective view of a convention jaw member illustrating the jaw roller and the roller pin.

FIG. 1 is a top view of a prior art power tong 1 such as disclosed in U.S. Pat. No. 5,435,213 to David A. Buck, which is incorporated by reference herein. FIG. 1 illustrates tong 1 with the top cover plate and top cage plate removed exposing to view ring gear 5, lower cage plate 7 and jaw members 10. Jaw members 10 are positioned between lower cage plate 7 and an upper cage plate (not shown). Jaw members 10 are also positioned in slots which are formed in the upper and lower cage plates such that jaw members 10 may move radially toward and away from tubular 8. As seen in FIG. 2, conventional jaw member 10 will have a jaw body 11 and a die 14 which will provide the surface actually engaging the tubular 8. Die 14 will attach to the front of jaw body 11 and be held in place when die clips 15 are attached to jaw body 11 by way of conventional screws (not shown) engaging clip apertures 16. The rear of jaw body 11 will have a roller aperture (not seen in FIG. 2, but similar aperture 23 seen in FIG. 4) which receives roller 12 such that roller 12 may be pivotally held in place by jaw pin 13. As suggested by FIG. 1, jaw member 10 is positioned in power tong 1 such that jaw roller 12 may engage cam surfaces 4 and 6. Ring gear 5 is mounted in the body 2 of power tong 1 on ring gear rollers 3 such that ring gear 5 may rotate relative to both the tong body 2 and the cage plates. Relative movement between ring gear 5 and the cage plates causes rollers 12 of jaw members 10 to ride onto positive cam surface 6 or neutral cam surface 4 and engage or disengage tubular 8. FIG. 1 illustrates the relative movement between cage plate 7 and ring gear 5 as having moved jaw members 10 on to positive cam surface 6 and into engagement with tubular 8. Generally a friction causing brake band (not shown) will hold the cage plates stationary as ring gear 5 begins its initial rotation. This allows jaw members 10 to ride onto positive cam surface 6 and engage tubular 8 without torque being applied to jaw members 10 and hence without torque being applied to tubular 8. As jaw members 10 travel further on cam surface 6, jaw members 10 tend to become, in effect, wedged between tubular 8 and cam surface 6. This produces the radial load on tubular 8 and imparts torque to the cage plates through jaw members 10. Continued rotation of ring gear 5 will eventually generate sufficient torque for the cage plates to overcome the frictional resistance of the brake band. At this point, the cage plates and ring gear 5 rotate together and torque will begin to be applied to tubular 8. The continued rotation of ring gear 5 not only supplies torque to jaw members 10, but also produces additional radial force against tubular 8. In order to prevent slipping between tubular 8 and jaw members 10, it is important that the radial force be sufficient to securely grip tubular 8 prior to significant torque being applied to jaw members 10. When tubular 8 is a comparatively small tubular, preventing slippage becomes even more difficult since small tubulars present less surface area to be gripped. Therefore it is advantageous to eliminate any unnecessary frictional forces that tend to prevent torque from producing a corresponding radial load on jaw members 10. As mentioned above, one source of friction are the rollers 12 of jaw members 10. Therefore the present invention provides a jaw member that substantially reduces the frictional forces caused by rollers 12.

Figure 3:
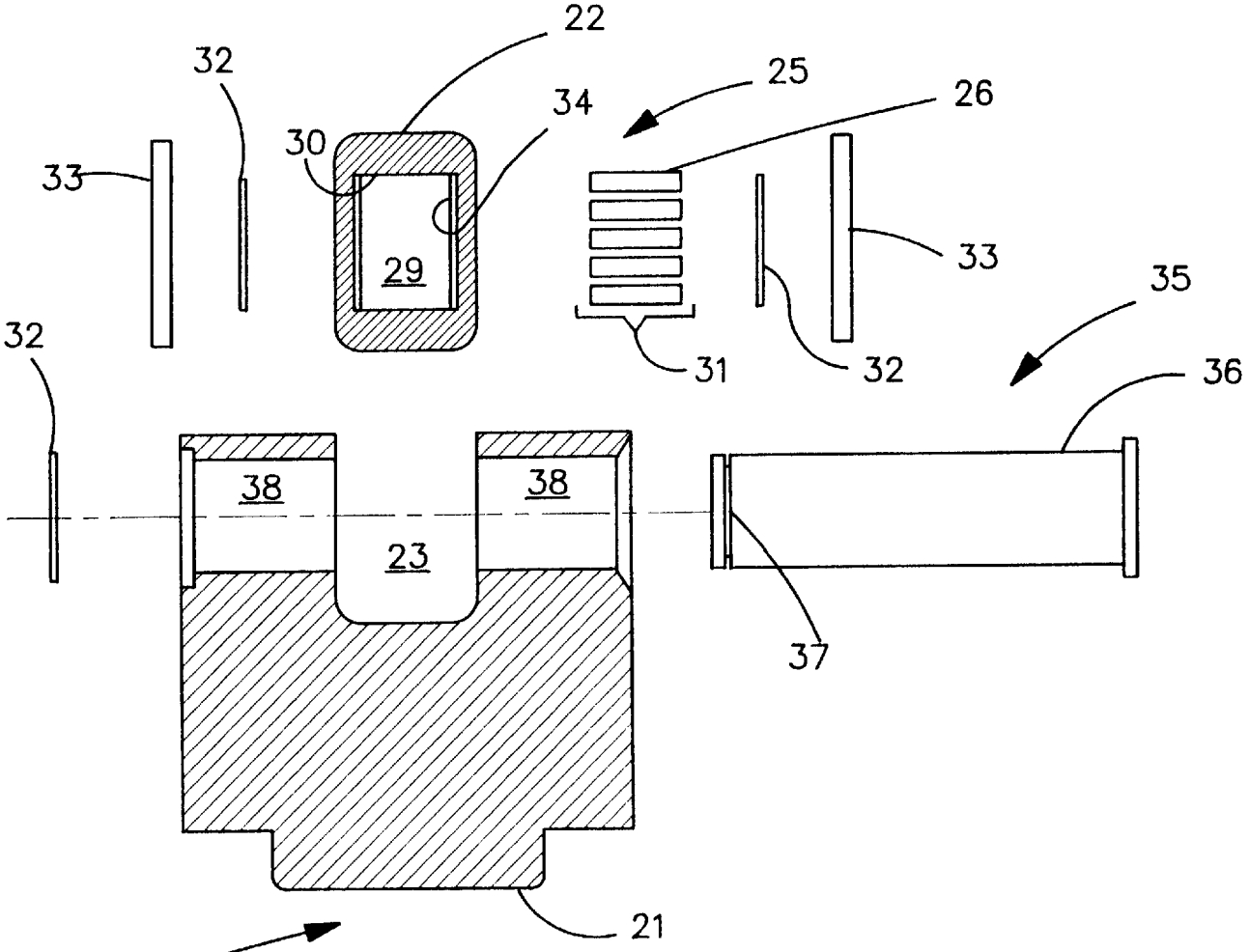
FIG. 3 is a cross sectional view of the improved jaw member which is the subject of the present invention.
Figure 4:
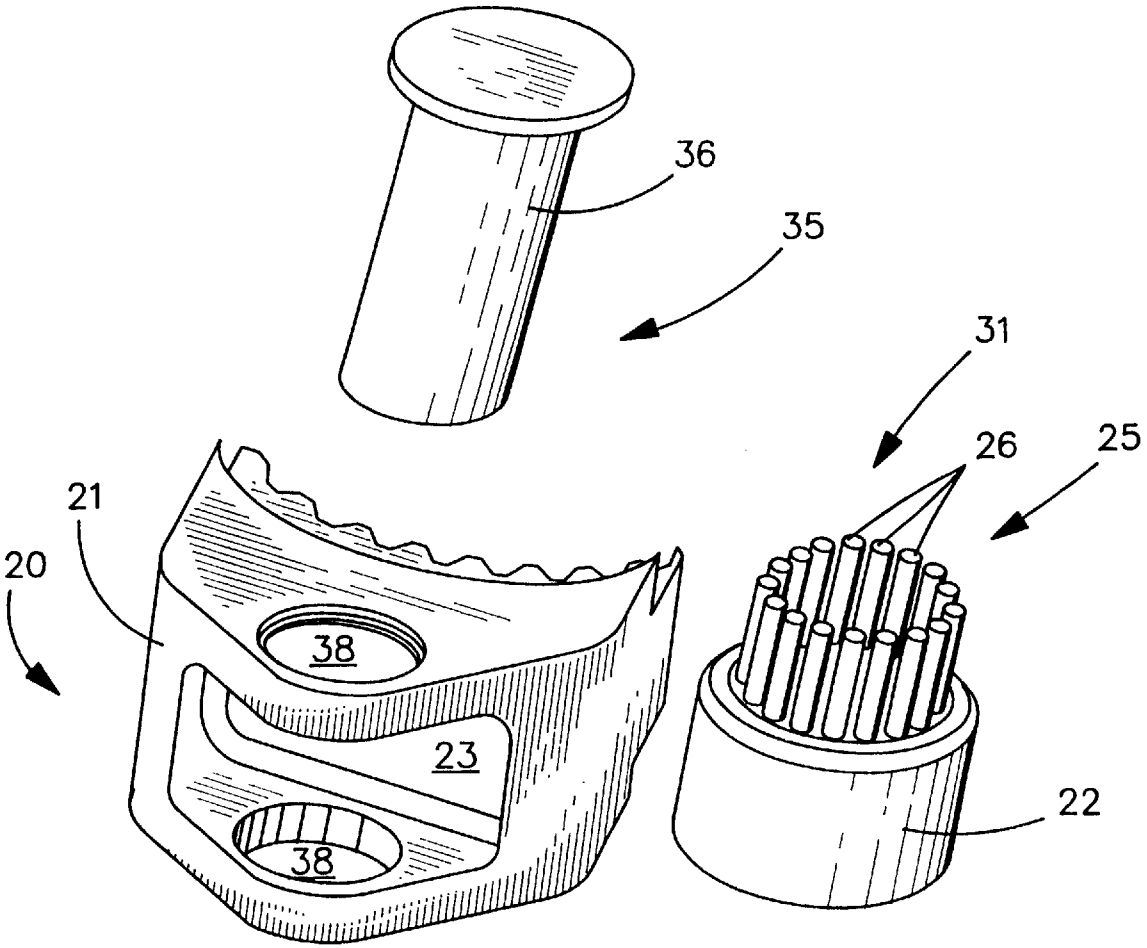
FIG. 4 is a rear perspective view of the improved jaw member illustrated in FIG. 3.

On embodiment of the present invention is seen in FIGS. 3 and 4. FIG. 4 illustrates how low friction jaw member 20 will generally comprise a jaw body 21 having a roller aperture 23 sized to receive a jaw roller 22. As best seen in the cross sectional view of FIG. 3, jaw body 21 will have retaining aperture 38 extending therethrough which is sized to receive roller retaining surface 35. In the embodiment shown in FIG. 4, roller retaining surface 35 is a jaw pin 36. Jaw roller 22 will include a retainer aperture 29 which has an inner diameter 30 Inner diameter 30 is sized sufficiently large to accommodate not only a friction reducing surface 31, but also jaw pin 36 which passes through retainer aperture 29. In the embodiment of FIG. 3, friction reducing surface 31 is a plurality of bearing members 25. More particularly, bearing members 25 comprises a plurality of needle bearings 26. As best seen in the perspective view of FIG. 4, needle bearings 26 will surround inner diameter 30 of jaw roller 22 in order to form friction reducing surface 31.

Still viewing FIG. 3, bearing members 25 will be secured in retainer aperture 29 by internal snap rings 32 engaging snap ring groove 34 or any similar device known in the art. In the embodiment shown in FIG. 3, jaw roller 22 is manufactured somewhat shorter than the length of roller aperture 23, and roller spacers 33 are positioned on each end of jaw roller 22 to insure jaw roller 22 fits securely in roller aperture 23. This embodiment of jaw roller 22 is manufactured at this length in order to allow conventional pins having a predetermined length to be used as needle bearings 26. Roller spacers 33 simply serve to adapt jaw roller 22 such that it may fit into the roller aperture 23 of conventional jaw members. Of course, those skilled in the art will readily recognize that one alternative is to simply manufacture needle bearings 26 to the length needed to accommodate a conventionally sized jaw roller 22. This modification and all other modifications are intended to come within the scope of the present invention. With roller bearing 25 installed as described above, jaw roller 22 will be positioned in roller aperture 23 and jaw pin 36 will be inserted through retaining apertures 29 and 38 and secured by internal snap ring 32 engaging snap ring groove 37. While in the embodiment shown roller retainer surface 35 is a conventional jaw pin 36, any type of roller retaining surface 35 is considered to come within the scope of the present invention. Additionally, the present invention includes any device that may be used for securing the roller retaining surface 35 in retaining aperture 38.

Figure 5:
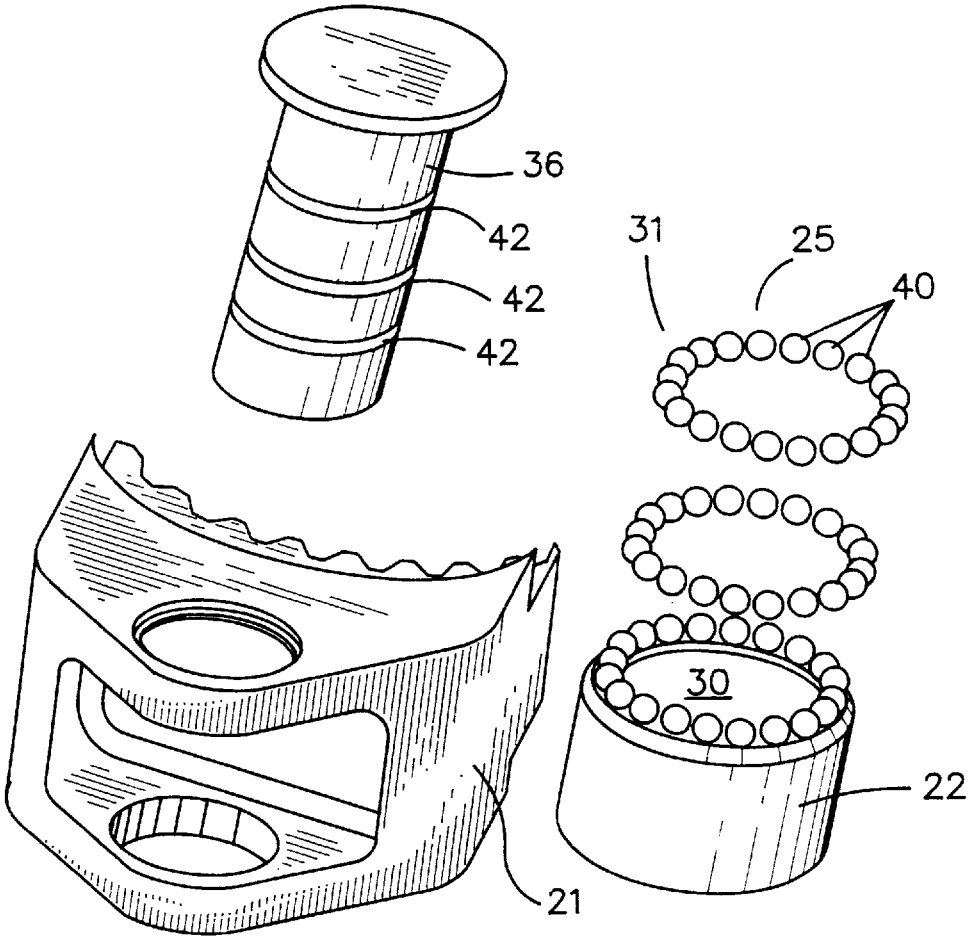
FIG. 5 is a rear perspective view showing an alternate embodiment of the present invention.

An alternative embodiment of the present invention is seen in FIG. 5. FIG. 5 represents an alternative friction reducing surface 31 to that shown in FIGS. 3 and 4. In FIG. 5, the bearing members 25 will comprise ball bearings 40 which will be positioned in a bearing groove 42 formed in jaw pin 36. Bearing groove 42 will have sufficient depth to retain ball bearing 40 while insuring enough of ball bearing 40 protrudes to contact inner diameter 30 of aperture 29. In the embodiment shown, there are 3 rows of ball bearings 40, but any suitable number of rows could be employed. Generally needle bearings 26 and ball bearings 40 may be may be manufactured from any wear resistant material, such as steel. Needle bearings 26 and ball bearings 40 will be manufactured from a material having a similar hardness as the material forming roller 22.

Figure 6:
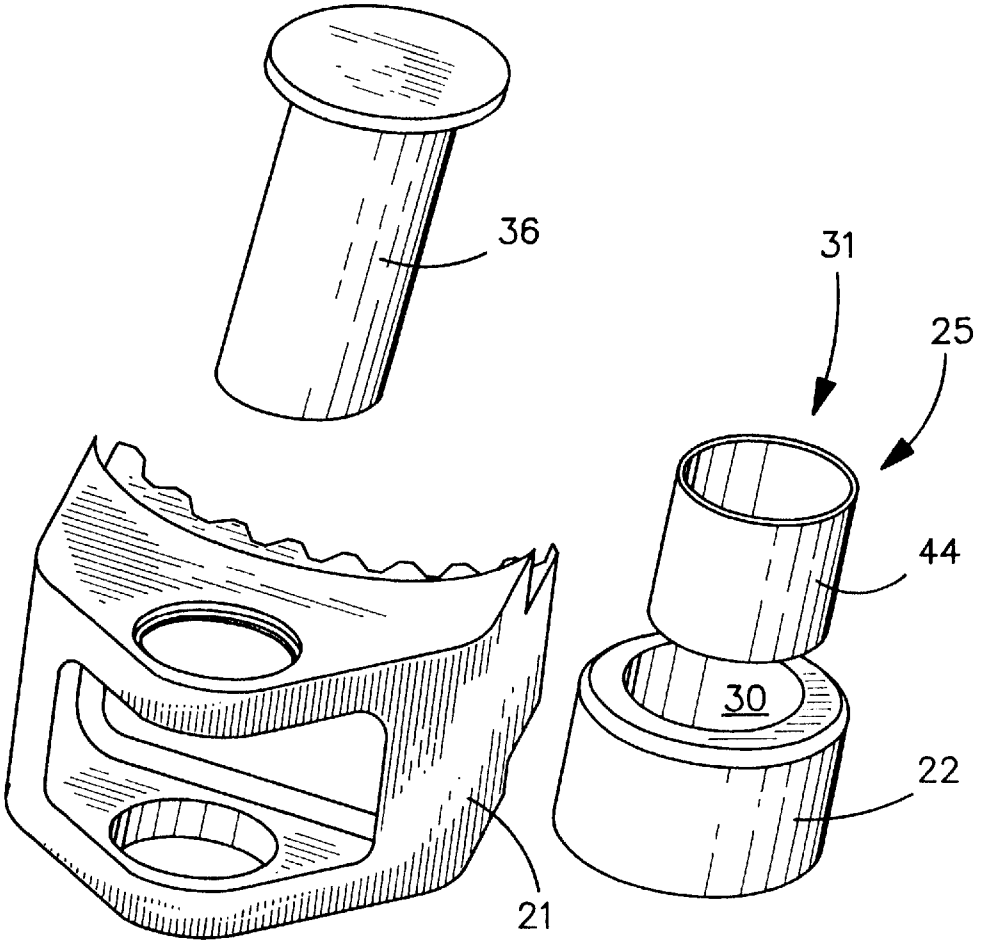
FIG. 6 is a rear perspective view showing another alternate embodiment of the present invention.

A still further alternative friction reducing surface 31 is seen in FIG. 6. FIG. 6 illustrates a bearing member 25 which comprises a sleeve bearing 44. Sleeve bearing 44 is cylindrically shaped and like needle bearings 26 and ball bearings 40, sleeve bearing 44 will be positioned between inner diameter 30 of jaw roller 22 and jaw pin 36. However, unlike needle bearings 26 and ball bearings 40, sleeve bearing 44 will not rotate within roller 22, but will be pressed into aperture 29 such that sleeve bearing 44 firmly engages inner diameter 30. Further, sleeve bearing 44 will be formed from a comparatively soft, low friction material, such as brass or sleeve bearing 44 may have a surface coating of low friction material such as Teflon® or a similar substance. In this manner, sleeve bearing 44 provides a low friction surface 31 in which jaw pin 36 may rotate.

Figure 7:
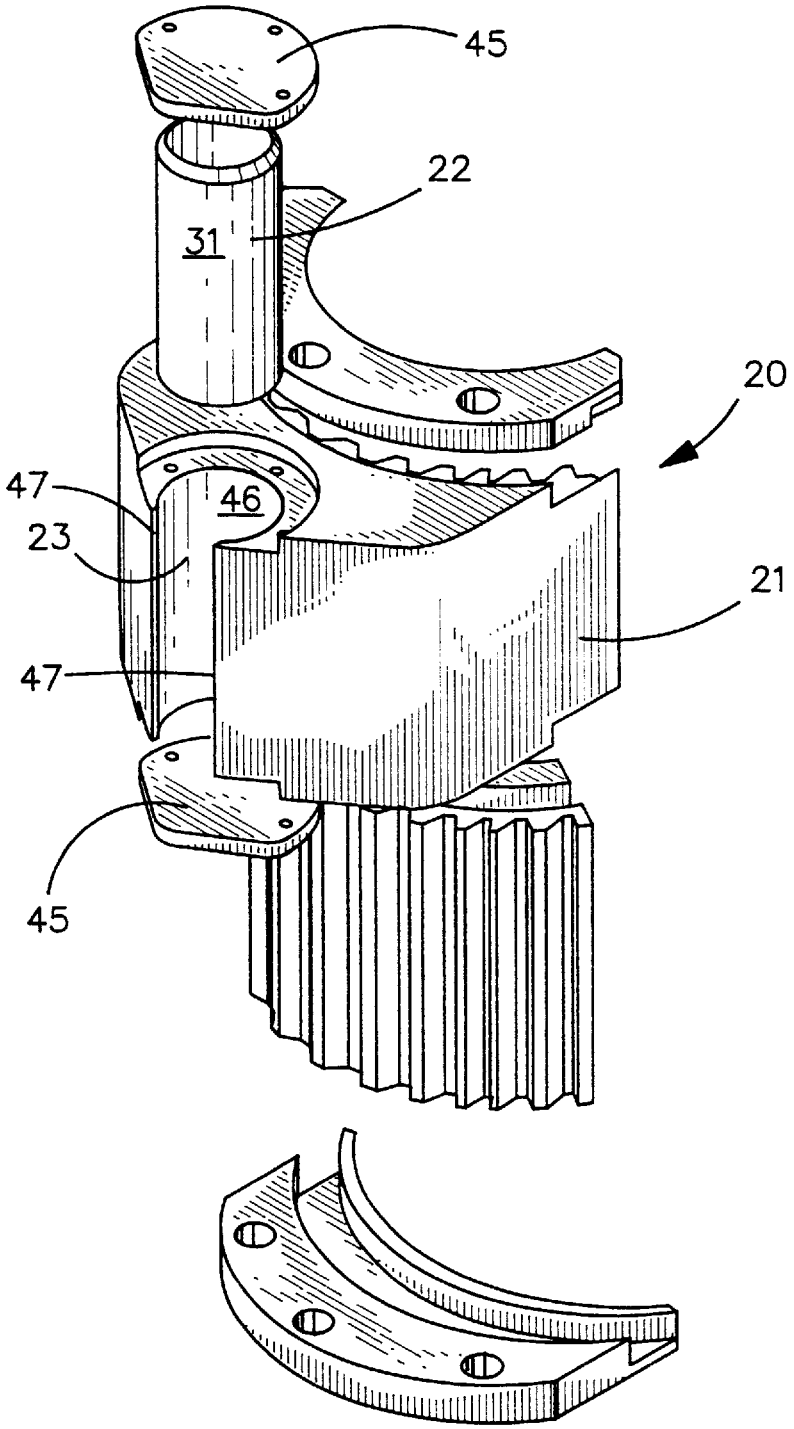
FIG. 7 is a rear perspective view showing another alternate embodiment of the present invention.

FIGS. 7–10 illustrate further alternate embodiments wherein roller retaining surface 35 comprises a structure other than a jaw pin 36. FIG. 7 shows a jaw member 20 having a jaw body 21 and a roller aperture 23 with open sidewalls 47. Roller aperture 23 is sized to have a diameter just slightly larger than jaw roller 22. Therefore when jaw roller 22 is inserted in jaw aperture 23, jaw roller 22 will be able to rotate within jaw aperture 23. Since roller aperture 23 does not completely inclose jaw roller 22, a section of jaw roller 22 will extend beyond open sidewalls 47 such that jaw roller 22 will be able to contact the cam surface of the power tongs. As seen in FIG. 7, sidewalls 47 will form in this embodiment the retaining surface 35 which holds jaw roller 22 within roller aperture 23. The inner walls of roller aperture 23 will form a contacting surface 46 against which jaw roller 22 will rotate. In this embodiment, a friction reducing surface 31, such as the Teflon® materials described above, is formed on jaw roller 22 such that jaw roller 22 may rotate against contacting surface 46 with a reduced frictional resistance. Alternatively, the friction reducing surface 31 could be formed on contacting surface 46 or even on both jaw roller 22 and contacting surface 46. Jaw member 20 will also include retainer plates 45 which will secure jaw roller 22 from vertical movement in roller aperture 23. The bearing structure shown in FIG. 7 is generally referred to in the art as a "journal bearing".

Figure 8:
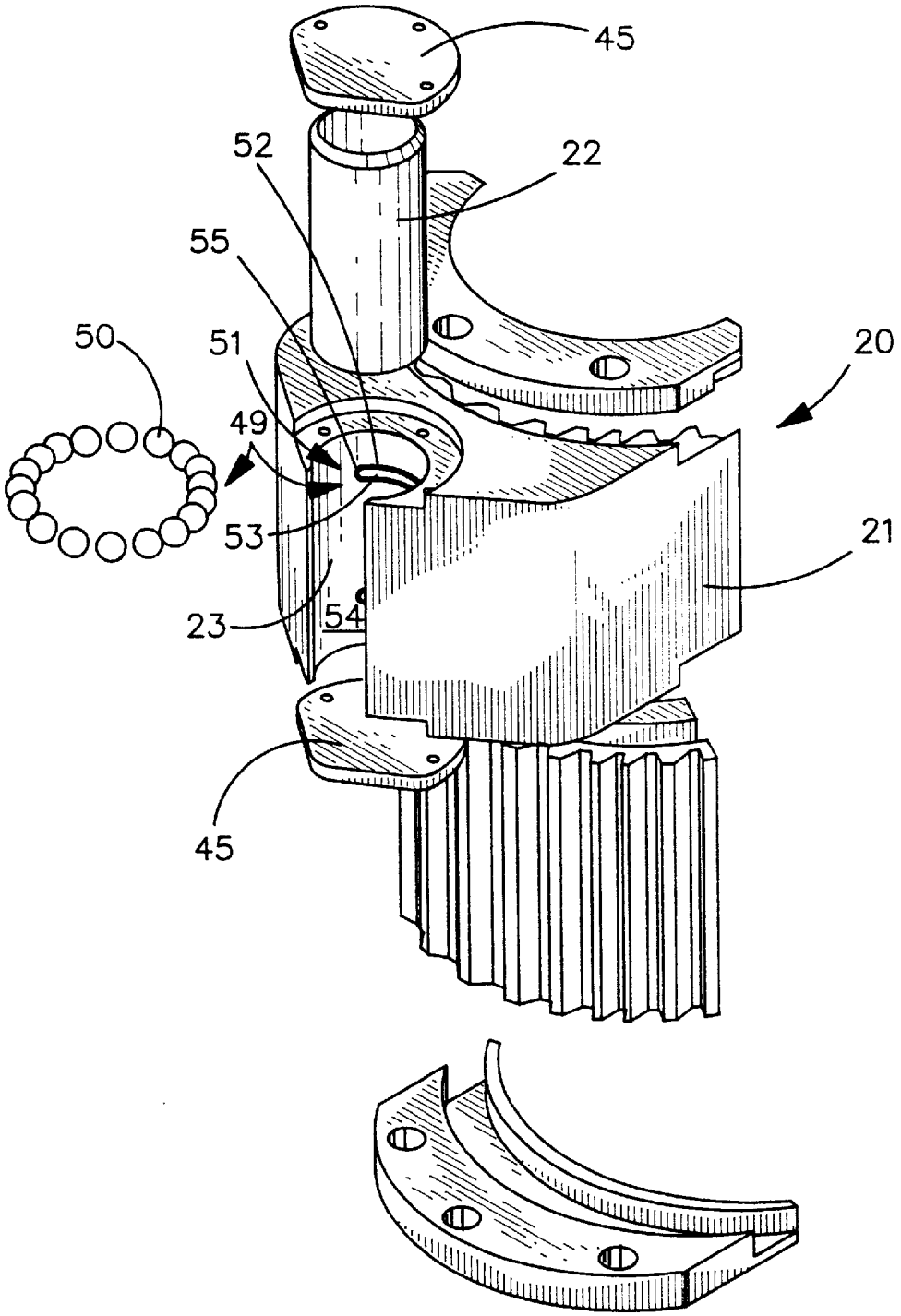
FIG. 8 is a rear perspective view showing still another alternate embodiment of the present invention.
Figure 9:
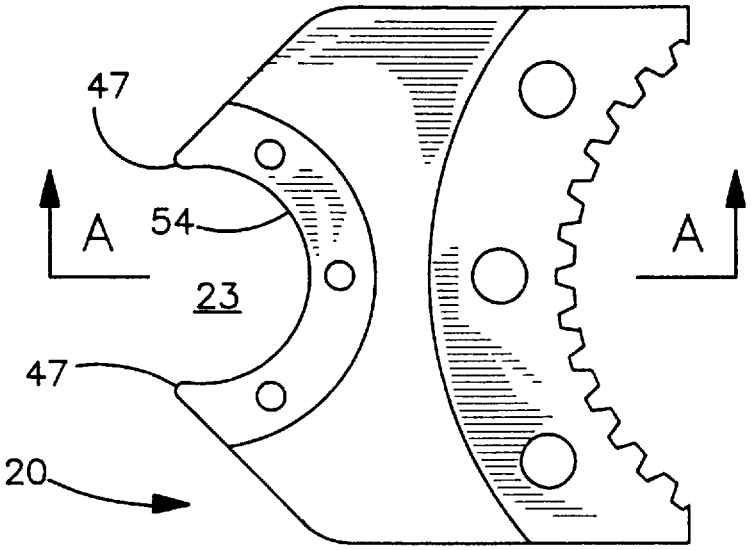
FIG. 9 is a top view of the embodiment of FIG. 8 illustrating section line A—A.
Figure 10:
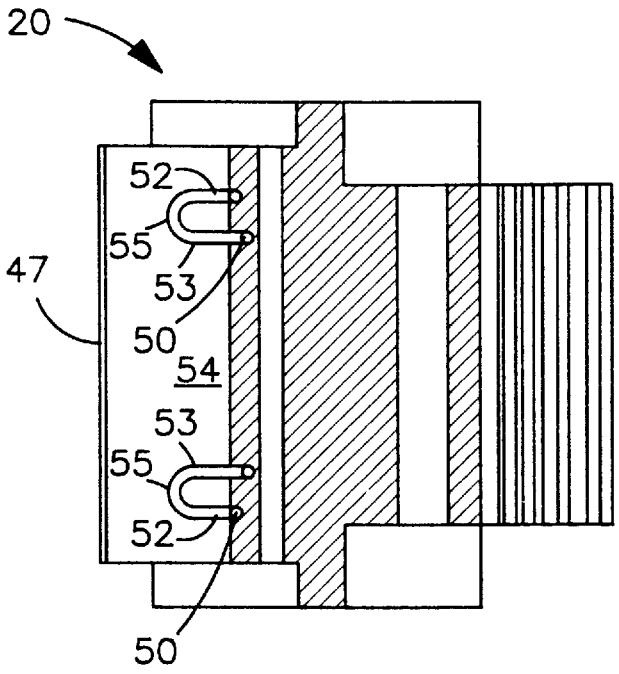
FIG. 10 is a cross sectional view of the embodiment of FIG. 8 take along the section line A—A.

FIGS. 8–10 illustrate still another variation of jaw member 20. This embodiment is similar to that of FIG. 7 in that it includes a jaw body 21, jaw roller 22, roller aperture 23 and retainer plates 45. However, the embodiment of FIG. 8 differs in that the friction reducing surface is formed by recirculating ball bearing system 49. Recirculating ball bearing system 49 will further comprise ball bearings 50 (shown removed from jaw member 20 in FIG. 8) and recirculating channel 51 which is formed on the aperture wall 54 of jaw aperture 23. Recirculating channel 51 is a continuous channel further comprising shallow bearing groove 52 and deep bearing groove 53. Shallow bearing groove 52 transitions into deep bearing groove 53 at curved sections 55 of recirculating channel 51. While only part of recirculating channel 51 is seen in the figures, it will be understood that the part of recirculating channel 51 hidden from view is symmetrical with that shown. As best seen in FIG. 10, deep bearing groove 53 will be cut far enough into aperture wall 54 that ball bearings 50 traveling therein will not pertrude beyond aperture wall 54 and cannot contact a jaw roller 22 positioned in aperture 23. On the other hand, shallow bearing groove 52 will be cut deep enough into aperture wall 54 to retained ball bearings 50, but will still be shallow enough to allow ball bearings 50 to pertrude beyond aperture wall 54 and contact a jaw roller 22.

In operation, a jaw roller 22 will be positioned in roller aperture 23 of the jaw member 20 illustrated in FIGS. 8-10. When roller 22 moves along the cam surface of the power tongs, it will rotate causing the ball bearings 50 in the shallow bearing groove 52 to move along the length of shallow bearing groove 52. As ball bearings 50 enter into curved section 55, circulating channel 51 will transition into deep bearing groove 53. It is preferable that ball bearings 50 move below the surface of aperture wall 54 prior to beginning movement in a vertical direction in curved section 55. Otherwise ball bearings 50 will not be able to roll horizontally and will present a less efficient friction reducing surface. Ball bearings 50 will circulate in the sense that jaw roller 22 is forcibly rolling ball bearings 50 toward one end of shallow bearing groove 52. As ball bearings 50 exit that end of shallow bearing groove 52 and enter in deep bearing groove 53, these ball bearings 50 will force ball bearings 50 in their front to travel along deep bearing groove 53 and enter shallow bearing groove 52 at its opposite end. In this manner, the rotation of jaw member 22 will cause a continuous circulation of ball bearings 50 between shallow bearing groove 52 and deep bearing groove 53.

Nor is the scope of the present invention limited to the specific embodiments illustrated above. Friction reducing surface 31 is intended to include all manner of mechanisms for reducing friction between jaw pin 36 and jaw roller 22. For example, if a proper seal is placed between jaw pin 36 and jaw roller 22, it is envisioned that a viscous liquid could serve as a friction reducing surface 31. All such modifications are considered within the scope of the present invention. Furthermore, those skilled in the art will recognize the significant advantages gained by reducing the friction forces acting on the jaw members of a power tong. For example, applicant has found that the present invention requires significantly less torque to achieve the same radial load as compared to prior art jaws. Applicant achieved these results by employing the present invention in a power tong similar to that disclosed in U.S. Pat. application Ser. No. 08/806,074 to David A. Buck, which is incorporated by reference herein. The power tong in question was a 5½ inch model tool (i.e., capable of gripping tubulars up to 5½ inches in diameter) and the test was performed on a 3½ inch tubular. When the prior art jaw assembly having no friction reducing surface was used in the power tong, a radial load of 40,000 lbs was transmitted to the tubular after the power tong had generate 4000 ft-lbs of torque on the tubular. By contrast, when a jaw as seen in FIG. 3 was used under the same conditions, a radial load of 40,000 lbs was transmitted to the tubular by the power tong generating only 1200 ft-lbs of torque. By way of explanation, it will be understood that it is the friction of the brake band which causes the radial loads given above to significantly exceed the torque loads. The torque load represents the amount of torque transferred to the tubular. However, no torque load is placed on the tubular until after the power tong generates enough torque to exceed the frictional resistance of the brake band. On the other hand, the radial load is being placed on the tubular as soon as the jaw members engage the tubular. This radial load increases on the tubular before the frictional resistance of the brake band is overcome and the radial load continues to increase after the bake band is overcome. Therefore, typically the radial load is relatively large as compared to the torque load placed on the tubular.

Finally, while many parts of the present invention have been described in terms of specific embodiments, it is anticipated that still further alterations and modifications thereof will no doubt become apparent to those skilled in the art. It is therefore intended that the following claims be interpreted as covering all such alterations and modifications as fall within the true spirit and scope of the invention.

I claim:

1. An improved power tong jaw comprising:

a. a jaw body with a roller aperture formed therein;

b. a jaw roller positioned in said roller aperture;

c. a roller retaining surface securing said jaw roller in said roller aperture; and d. a friction reducing surface formed between said jaw roller and said roller retaining surface.

2. An improved power tong jaw according to claim 1, wherein said jaw roller has a retainer aperture formed therein.

3. An improved power tong jaw according to claim 2, wherein said roller retainer surface is a jaw pin positioned in said retainer aperture.

4. An improved power tong jaw according to claim 1, wherein said retainer aperture extends through said jaw body.

5. An improved power tong jaw according to claim 3, wherein said friction reducing surface is a bearing member positioned between said jaw pin and an inside surface of said retainer aperture.

6. An improved power tong jaw according to claim 5, wherein said bearing member is a pin bearing.

7. An improved power tong jaw according to claim 5, wherein said bearing member is a ball bearing.

8. An improved power tong jaw according to claim 5, wherein said bearing member is a sleeve bearing.

9. An improved power tong jaw comprising:

a. a jaw body with a roller aperture formed therein;

b. a jaw roller means positioned in said roller aperture;

c. a roller retaining means securing said jaw roller means in said roller aperture; and d. a friction reducing means formed between said jaw roller means and said roller retaining means.

10. An improved power tong jaw comprising:

a. a jaw body with a roller aperture formed therein, said roller aperture further including a roller contacting surface;

b. a jaw roller positioned in said roller aperture;

c. a friction reducing surface formed between said jaw roller and said roller contacting surface.

11. An improved power tong jaw according to claim 10, wherein said jaw has a roller retaining surface for maintaining said jaw roller in said roller aperature.

12. An improved power tong jaw according to claim 10, wherein said friction reducing surface comprises a journel bearing.

13. An improved power tong jaw according to claim 10, wherein said friction reducing surface comprises a recirculating ball bearing.

* * * * *